US006228191B1

(12) United States Patent
Leenders

(10) Patent No.: US 6,228,191 B1
(45) **Date of Patent: *May 8, 2001**

(54) GAS-GENERATING PREPARATION WITH IRON AND/OR COPPER CARBONATE

(75) Inventor: Adriana Petronelle Martina Leenders, Ka Den Hoorn (NL)

(73) Assignee: Nederlandse Organisatie voor Toegepast-Natuurwetenschappelijk Onderzoek (TNO), Delft (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/976,583

(22) Filed: Nov. 24, 1997

(30) Foreign Application Priority Data

Nov. 26, 1996 (NL) ..... 1004618

(51) Int. Cl.[7] ..... C06B 45/10

(52) U.S. Cl. ..... 149/19.6; 149/19.91; 149/36; 149/46; 149/47

(58) Field of Search ..... 149/19.1, 19.6, 149/19.91, 47, 46, 36

(56) References Cited

U.S. PATENT DOCUMENTS

| | | | | |
|---|---|---|---|---|
| 2,904,420 | | 9/1959 | Holker . | |
| 5,035,757 | | 7/1991 | Poole . | |
| 5,197,758 | * | 3/1993 | Lund et al. | 149/61 |
| 5,429,691 | * | 7/1995 | Hinshaw et al. | 149/45 |
| 5,551,725 | * | 9/1996 | Ludwig | 280/741 |
| 5,641,938 | * | 6/1997 | Holland et al. | 149/48 |
| 5,756,929 | * | 5/1998 | Lundstrom et al. | 149/22 |
| 5,827,996 | * | 10/1998 | Yoshida et al. | 149/45 |
| 5,872,329 | * | 2/1999 | Burns et al. | 149/36 |

FOREIGN PATENT DOCUMENTS

| | | |
|---|---|---|
| 765865 | 1/1957 | (GB) . |
| 818290 | 8/1959 | (GB) . |
| WO 96/27574 | 9/1996 | (WO) . |

* cited by examiner

*Primary Examiner*—Edward A. Miller
(74) *Attorney, Agent, or Firm*—Young & Thompson

(57) ABSTRACT

A gas-generating preparation suitable for being used in an air bag includes ammonium nitrate, a derivative of guanidine and one or more metal carbonates as a deflagration catalyst. By using one or more metal carbonates as a deflagration catalyst, higher burning rates and a lower burning temperature are achieved than if metal oxides such as copper(II) oxide are used as a deflagration catalyst.

8 Claims, No Drawings

GAS-GENERATING PREPARATION WITH IRON AND/OR COPPER CARBONATE

BACKGROUND OF THE INVENTION

The invention relates to a gas-generating preparation. In particular, the invention relates to a preparation comprising (a) ammonium nitrate, (b) a derivative of guanidine and (c) a deflagration catalyst which comprises one or more inorganic compounds, the preparation being able to produce a large amount of gas in a very short time. The invention further relates to the use of such a gas-generating preparation in an air bag.

For the purpose of the invention, an air bag is to be understood as a system comprising a sensor, a gas-generating preparation, an igniter for the gas-generating preparation and an inflatable reservoir in a folded state, which in the event of a dangerous situation can be inflated very quickly.

DESCRIPTION OF THE RELATED ART

Such a preparation is disclosed in U.S. Pat. No. 2,904,420. This preparation mainly comprises an oxidant, an organic combustible, an igniter and a cooling agent, the oxidant being an alkali metal nitrate or an ammonium nitrate, the organic combustible being guanidine nitrate or nitroguanidine, the igniter being copper in powdered form, a copper compound, a chromate compound or a polychromate compound, and the cooling agent being a naturally occurring magnesium carbonate such as magnesite or dolomite. The preparation contains from 15 to 40 wt % of the magnesium carbonate and—according to the examples—at most 34.2 wt % of ammonium nitrate. To prepare the preparations according to the U.S. Pat. No. 2,904,420 it may, owing to the addition of the cooling agent for reducing the burning rate, be necessary to choose such a quantity of the cooling agent that adequate cooling is obtained while still retaining a specific burning rate. It is also stated that the use of naturally occurring magnesium carbonate such as dolomite or magnesite in the gas-generating preparations is more effective than the use of magnesium carbonate or calcium carbonate which have been prepared by precipitation of these salts from solutions of magnesium salts or calcium salts in water.

A gas-generating preparation of this type is also disclosed by DE-A-195,505,569, which describes a preparation comprising a combustible, an oxidant, a deflagration catalyst and optionally an additive, the purpose of this additive being to diminish the formation of the amount of toxic substances. The combustible is a nitrogen-containing compound such as nitroguanidine or guanidine nitrate. The oxidant is a mixture of at least three peroxide, nitrate, chlorate and/or perchlorate compounds, one possible example of the nitrate compound being ammonium nitrate. The deflagration catalyst can be a metal carbonate, for example copper carbonate or iron carbonate. The preparation according to DE-A-19,505,569 preferably contains approximately 60 wt % of oxidants and up to approximately 8% of the deflagration catalyst.

A drawback of the gas-generating preparations according to the U.S. Pat. No. 2,904,420 and according to DE-A-19,505,569 is that these preparations are complex mixtures.

In addition, German utility model 9416112 describes gas-generating compositions which comprise at least (a) a carbonate, a hydrogen carbonate or a nitrate of guanidine, aminoguanidine, diaminoguanidine or triaminoguanidine, (b) an alkali metal nitrate or alkaline earth metal nitrate or ammonium nitrate and (c) a support material such as silicon dioxide, alkali metal silicates or alkaline earth metal silicates or aluminium silicates and/or an oxygen-supplying support material such as iron(III) oxide and copper(II) oxide. Also, instead of a carbonate, a hydrogen-carbonate or a nitrate of triaminoguanidine, it is possible to use nitroguanidine. The compositions can contain from 20 to 55 wt % of (a), from 45 to 80 wt % of (b) and from 5 to 45 wt %, based on the total amount of (a) and (b), of component (c). The compositions may optionally include a binder such as cellulose compounds or organic polymers.

Compositions such as those described in German utility model 9416112, in particular compositions which contain ammonium nitrate and triaminoguanidine nitrate or ammonium nitrate and nitroguanidine, proved to have the drawback that these compositions do not burn quickly enough and are not suitable, as such, for use in an air bag. A further drawback is that combustion of these compositions entails a too high burning temperature.

It was found that using certain metal carbonates as a deflagration catalyst both reduces the burning temperature and increases the burning rate of the composition. The invention therefore relates to a gas-generating preparation as noted above wherein the preparation comprises from 50 to 75 wt % of ammonium nitrate and the deflagration catalyst is copper(II) carbonate or iron(III) carbonate or a mixture thereof.

The metal carbonate is preferably iron(III) carbonate, copper(II) carbonate or a mixture thereof, in particular copper(II) carbonate.

Air bags are currently often used in cars. In the event of a collision the sensor will respond, whereupon an electric signal is transmitted to the igniter. The igniter ensures rapid decomposition of the gas-generating preparation with the formation of a large amount of gas by which the air bag is inflated very rapidly. In the event of the collision a person is then flung against the air bag which is in its inflated state. As a result, the person will not come into contact with any hard object in the car, for example the dashboard or the steering wheel, and the air bag consequently prevents the person from suffering serious injury.

The gas-generating preparation of an air bag according to the prior art is usually based on sodium azide. Such a preparation has two drawbacks. Firstly, the amount of heat generated is not sufficient for complete decomposition of the sodium azide. Secondly, sodium is formed as a by-product. The sodium reacts with humidity from the air and/or with moisture from the body, for example perspiration moisture, with the formation of sodium hydroxide which may lead to burns suffered by the person or persons present in the car.

Attempts have been made to overcome this problem by using, in an air bag, gas-generating preparations which, in addition to sodium azide, contain an oxidant, for example inorganic oxidants such as iron(III) oxide or copper(II) oxide or organic oxidants such as ammonium chloride, hydrazine chloride, hydroxylamine chloride and ammonium nitrate. In the process, the sodium formed in the decomposition of sodium azide is converted by the oxidant into sodium oxide. Albeit less violently, sodium oxide likewise reacts however, with humidity from the air and/or moisture from the body to give sodium hydroxide. These systems are not satisfactory, however, since the efficiency of gas formation is not optimal.

Use has also been made of gas-generating preparations containing sodium azide and metal halides, potassium perchlorate, metal powder and graphite, the objective being not to form any sodium or sodium oxide in the course of the decomposition of the gas-generating preparation. These gas-generating preparations have the drawback that their decomposition entails the formation of a large amount of solid particles. These particles, given the high temperature, often cause burns. Consequently, these particles need to be intercepted by means of a filter. The particles formed in the course of the decomposition are very small, however, and intercepting them by using an external filter proves difficult. Another drawback of the gas-generating preparations is that, since large quantities of solid particles are formed, the efficiency with which gas is formed is low.

Also known are gas-generating preparations based on sodium azide, which contain a so-called internal filter material. This filter material includes a low-melting material comprising metal oxides, which melts when the gas-generating preparation decomposes and is consequently able to capture the solid particles formed in the decomposition. This results in larger, tacky particles which can be intercepted more readily by means of an external filter. However, since these gas-generating preparations contain relatively large amounts of the internal filter material, these gas-generating preparations likewise have the drawback that the efficiency with which gas is formed is low.

Another problem with using sodium azide in a gas-generating system for an air bag is that in most cases air bags remain intact for the entire life of a car (after all, most cars are not involved in collisions). When scrap cars are processed by recycling firms, this may expose the staff to major hazards. Firstly, sodium azide is a toxic compound. Another problem is that any sodium azide released reacts with humidity from the air, with the formation of hydrazoic acid ($HN_3$) which likewise is a highly toxic compound and readily explodes.

In contrast to the abovementioned systems in which gaseous nitrogen is formed, systems are also known in which carbon dioxide is formed. These systems comprise a binder combustible comprising a glycidyl ether, the binder being cured by means of triethylene tetraamine or maleic anhydride. As an auxiliary combustible, oxamide or ethylene carbonate is added, and $KClO_3$ is employed as an oxidant. These systems have the drawback that, in the course of the decomposition of the gas-generating preparation, not only carbon dioxide but also considerable amounts of the toxic carbon monoxide are formed. Since the presence of carbon dioxide induces more rapid respiration, a noxious gas such as carbon monoxide will likewise be absorbed more rapidly.

Consideration has also been given to the use of systems comprising one or more propellants ("single-base" or "double-base" propellants, i.e. propellants based on nitrocellulose and based on nitrocellulose and nitroglycerine) as a gas-generating preparation for air bags. The known systems likewise have the drawback that considerable amounts of toxic and/or combustible gaseous substances, for example carbon monoxide, ammonia, hydrogen cyanide, nitrogen oxides, hydrogen chloride and the like are formed in the course of the decomposition of the gas-generating preparations. Moreover, such systems are not sufficiently stable at the prevailing ambient temperature in a car, which can easily be more than 100° C., and are therefore unsuitable as a gas-generating preparation for an air bag.

Systems based on azodicarbonamide and potassium perchlorate are likewise unsuitable for being used in an air bag, since, in the course of the decomposition of these, large amounts of hydrogen and carbon monoxide are released.

Gas-generating preparations containing ammonium nitrate and glycidylazido polymer have the drawback that the decomposition of these often gives rise to the formation of unacceptable quantities of nitrogen oxides. Another drawback of ammonium nitrate is that it has a phase transition at 32° C. and that repeated temperature changes consequently lead to the ammonium nitrate expanding and shrinking and ultimately cracking or even disintegrating into powder. Moreover, the burning rate of ammonium nitrate is low.

The above therefore reveals that the use of known gas-generating preparations in an air bag is associated with major problems.

SUMMARY OF THE INVENTION

An advantage of the gas-generating preparation according to the invention is that it does not contain any toxic base materials and that its decomposition produces gas highly efficiently, no toxic, corrosive and/or solid substances being formed in the process. Another advantage is that the above-described problems which may occur when ammonium nitrate is used will not occur when the preparation according to the invention is used.

According to the invention, the gas-generating preparation advantageously comprises compounds which contain few carbon and hydrogen atoms and which contain many nitrogen atoms. Highly advantageously, if the gas-generating preparation comprises compounds which contain carbon atoms, the number of nitrogen atoms in these compounds per carbon atom is at least two and preferably at least three.

It was found that during the decomposition of gas-generating preparations which comprise at least ammonium nitrate, a derivative of guanidine and one or more metal carbonates, very small amounts of nitrogen oxides or even none at all are formed. Since the derivatives of guanidine contain few carbon atoms, carbon monoxide formation is likewise very low.

DESCRIPTION OF THE PREFERRED EMBODIMENT

In the present description a derivative of guanidine is to be understood as a compound in which the carbon atom or carbon atoms are bound directly to three nitrogen atoms. Examples of suitable derivatives of guanidine such as those which can be used in the gas-generating preparation according to the invention are triaminoguanidine azide, guanidineditetrazole, aminoguanidineditetrazole, bis(triaminoguanidium)-5,5'-azotetrazole, 5-guanylaminotetrazole, triaminoguanidine nitrate, ammonium-5-nitroaminotetrazole, triaminoguanidine-5-nitroaminotetrazole, and nitroguanidine. The preparation according to the invention preferably contains triaminoguanidine nitrate and/or nitroguanidine. According to the invention it is possible to use, in addition to or instead of triaminoguanidine nitrate and/or nitroguanidine, one or more derivatives of guanidine, for example those mentioned above. If in addition to, or instead of, triaminoguanidine nitrate and/or nitroguanidine, one or more other derivatives of guanidine are used, the substituents of these compounds preferably contain nitrogen atoms and as few carbon atoms as possible and in particular no carbon atoms. Examples of such substituents are cyano, amino, hydrazino, azido and nitro groups.

According to the invention the gas-generating preparation may advantageously also comprise an oxidant. This oxidant ensures that any carbon monoxide formed is converted into carbon dioxide and increases the burning rate of the preparation. According to the invention the deflagration catalyst for causing the preparation to burn more rapidly is also able to oxidize the gaseous combustion products such as carbon monoxide. Other suitable oxidants are inorganic oxidants such as, for example, copper(II) oxide or iron(III) oxide and in particular copper(II) oxide. If required, the preparation may, based on the amount of deflagration catalyst, contain from 0.1 to 50 wt %, preferably from 0.5 to 25 wt % and in particular from 1 to 15 wt % of copper(II) oxide or iron(III) oxide. The oxidant and the deflagration catalyst may be the same type as compounds, and consequently the oxidants may also be one or more metal carbonates such as copper(II) carbonate and iron(III) carbonate.

The gas-generating preparation according to the invention comprises from 50 to 75 wt % of ammonium nitrate and preferably from 25 to 50 wt % of a derivative of guanidine and from 0.5 to 25 wt % of the deflagration catalyst. The gas-generating preparation according to the invention in particular comprises from 55 to 70 wt % of ammonium nitrate, from 30 to 45 wt % of a derivative of guanidine and from 1.0 to 15 wt % of the deflagration catalyst.

The gas-generating preparation according to the invention may also contain one or more binders. Preferably the preparation, based on the total amount of ammonium nitrate, the derivative of guanidine and of the deflagration catalyst, contains from 0.1 to 20 wt %, in particular from 0.5 to 15 wt % of at least one binder. If the preparation, for example, contains 20 wt % of one or more binders, the remaining 80 wt % of the preparation consists of ammonium nitrate, the derivative or derivatives of guanidine and the deflagration catalyst in the proportions given above, the deflagration catalyst being composed of one or more metal carbonates and possibly one or more metal oxides. Examples of suitable compositions of the preparation are reproduced in the table below, quantities of the constituents being such that the total amount is 100 wt %.

TABLE

| | Ammonium nitrate (wt %) | Derivative of guanidine (wt %) | Metal carbonate (wt %) | Metal oxide (wt %) | Binder (wt %) |
|---|---|---|---|---|---|
| 1 | 50–75 | 25–50 | 0.5–25 | — | — |
| 2 | 55–70 | 30–45 | 1.0–15 | — | — |
| 3 | 40–60 | 20–40 | 0.4–20 | — | 0.1–20 |
| 4 | 42–64 | 21–42 | 0.4–22 | — | 0.5–15 |
| 5 | 50–75 | 25–50 | 0.25–12.5 | 0.25–12.5 | — |
| 6 | 55–70 | 30–45 | 0.5–7.5 | 0.5–7.5 | — |
| 7 | 50–75 | 25–50 | 0.37–18.7 | 0.13–6.3 | — |
| 8 | 55–70 | 30–45 | 0.75–11.25 | 0.25–3.75 | — |
| 9 | 40–60 | 20–40 | 0.2–10 | 0.2–10 | 0.1–20 |
| 10 | 42–64 | 21–42 | 0.2–11 | 0.2–11 | 0.5–15 |

Suitable as binders are organic polymers, preferably thermoplastic organic polymers which contain few carbon and hydrogen atoms and preferably many oxygen atoms. Preferably, the binder is polyethylene glycol or poly(vinyl nitrate). In the context of the abovementioned problems with, inter alia, the formation of carbon monoxide it will be evident that if the preparation according to the invention is used in an air bag, the preparation will contain a relatively small quantity of such a binder.

If the gas-generating preparation according to the invention contains a binder, the preparation will contain, as the binder, in particular polyethylene glycol, poly(vinyl nitrate) or a mixture thereof. The gas-generating preparation is preferably produced as a solid preparation in the from of tablets, granules or pellets.

An important characteristic of a gas-generating preparation is the burning rate of the preparation, since gas-generating preparations are used precisely in those cases where a large quantity of gas is required in a short period. The burning rate of the gas-generating preparation according to the invention is at least 15 mm/s, usually greater than 20 mm/s and preferably greater than 30 mm/s. It should be noted that the shape of the gas-generating preparation, in particular the "burning surface" has a large effect on the rate at which the gas is formed.

In the discussion of the prior art it was stated that certain applications require the combustion of a gas-generating preparation to produce gas which does not contain any hazardous, toxic or corrosive products. In particular it is a requirement for the gas thus formed to contain little or no carbon monoxide, nitrogen oxides and the like. The gas-generating preparation according to the invention, when decomposed by combustion, indeed preferably forms less than 1.26 wt % of carbon monoxide and less than 350 ppm of nitrogen oxides, calculated as $NO_2$.

The preparation according to the invention can be prepared, for example, by ammonium nitrate being blended with at least triaminoguanidine nitrate and/or nitroguanidine and the deflagration catalyst and possibly a binder, and this blend then being compressed to produce tablets, granules or pellets.

The gas-generating preparation according to the invention is highly suitable for being used in an air bag. The preparation according to the invention contains no toxic base materials. Moreover, the combustion of the preparation according to the invention solely releases nonhazardous substances such as nitrogen, water and carbon dioxide, and only a very small quantity of carbon monoxide is formed.

The gas-generating preparation according to the invention is also suitable for uses in other life-saving aids, for example as a propellant for a fire-extinguishing powder for extinguishing a fire in a small space from which escape is not possible, for example an aeroplane. The gas-generating preparation can also be used as a propellant for atomizing smoke-generating particles.

The invention will be explained in more detail with reference to the following examples.

EXAMPLE I

This trial describes the measurement of the burning rate of the gas-generating preparation according to the invention. The burning rate was determined as a function of the pressure. This involved a sample of the preparation being burnt in a so-called L* burner. An L* burner is a combustion chamber where combustion takes place at constant pressure. The L* burner is provided with an outlet orifice whose size can be altered. By varying the size of the outlet orifice it is possible to determine the burning rate as a function of the pressure P, the way the burning rate depends on the pressure being defined as:

$$R=a*p^b$$

where R is the burning rate (mm/s), a is a constant which depends on the gas-generating preparation used, P is the pressure (MPa) and b is the pressure exponent.

The pressure exponent b preferably has a value which does not exceed 1. If the value exceeds 1, the burning rate is such that more gas is formed in the combustion chamber than can be discharged through the outlet orifice. This would result in an uncontrolled pressure build-up.

The L* burner was also provided with a turbulence grille to obtain good mixing of the gases. The outlet orifice was provided with a stainless steel container which cools the gases formed. As a result the gases were able to be collected in a plastic bag for analysis.

The trial was carried out as follows. Two discs of a sample of the preparation, having a diameter of 5 cm and a height of 1 cm, were placed in the mount of the L* burner. The outer edge of the discs was lubricated with silicone rubber which acted as a fire retardant, so that the discs were burning off in a downward direction. The discs were ignited by means of Davey Brickford igniters. It was then determined how long a particular constant pressure was able to be maintained for while the discs were burning. The burning rate was then determined as follows:

$$R=1/t$$

where R is the burning rate (mm/s), 1 is the height of the disc (cm) and t is the burning time (s). The results of this trial are shown in Table A, where TAGN is triaminoguanidine nitrate and AN is ammonium nitrate and the quantities are given in wt %.

TABLE A

| | Composition (wt %) | | | Pressure | R |
|---|---|---|---|---|---|
| Exp. | TAGN | AN | Catalyst | (MPa) | (mm/s) |
| 1 | 37.0 | 63.0 | — | 8.9 | 9.1 |
| 2 | 35.6 | 60.5 | 3.9 (CuO) | 8.3 | 20.0 |
| 3 | 35.6 | 60.5 | 3.9 (CuO) | 10.7 | 27.0 |
| 4 | 34.9 | 59.2 | 5.9 ($CuCO_3$) | 9.0 | 38.9 |

Comparison of the results of experiments 1–3 with those of experiment 4 clearly shows that the use of copper(II) carbonate as a deflagration catalyst results in a much higher burning rate.

EXAMPLE II

In this trial the increase in the burning rate and in the amount of carbon monoxide formed was determined as a function of the amount of $CuCO_3$ in the preparation.

In two comparative experiments it was observed that combustion of a preparation comprising 37 wt % of triaminoguanidine nitrate and 63.0 wt % of ammonium nitrate in the L* burner resulted in the formation of 1.8–2.4 wt % of carbon monoxide. If the trial was repeated with a preparation comprising 34.9 wt % of triaminoguanidine nitrate, 59.2 wt % of ammonium nitrate and 5.9 wt % of $CuCO_3$, the burning rate was increased and less carbon monoxide was formed.

EXAMPLE III

In this trial, experiments were carried out with samples of the preparation, but using nitroguanidine instead of triaminoguanidine nitrate. The compositions of these samples corresponded to those shown in Table A. It was found that at comparable pressures burning rates were obtained which are comparable with the burning rates according to Table A.

EXAMPLE IV

Calculations were carried out on the basis of the various compositions of the preparation, the compositions containing, as the deflagration catalyst, copper(II) oxide or copper(II) carbonate. The molar fraction of deflagration catalyst was identical in all the compositions, i.e. 3.9 wt % of copper(II) oxide corresponds to 5.9 wt % of copper(II) carbonate. These calculations clearly show that if copper(II) carbonate is used instead of copper(II) oxide, a lower burning temperature is obtained. The results of these calculations are shown in Table B.

TABLE B

| | Composition (wt %) | | | Temperature |
|---|---|---|---|---|
| Exp. | TAGN | AN | Catalyst | (K.) |
| 1 | 37.0 | 63.0 | — | 2505 |
| 2a | 36.6 | 62.1 | 1.3 (CuO) | 2490 |
| 2b | 36.3 | 61.7 | 2.0 ($CuCO_3$) | 2478 |
| 3a | 35.6 | 60.5 | 3.9 (CuO) | 2463 |
| 3b | 34.9 | 59.2 | 5.9 ($CuCO_3$) | 2429 |
| 4a | 34.7 | 58.9 | 6.4 (CuO) | 2433 |
| 4b | 33.3 | 56.7 | 10.0 ($CuCO_3$) | 2370 |
| 5a | 33.2 | 54.9 | 12.9 (CuO) | 2347 |
| 5b | 29.6 | 50.4 | 20.9 ($CuCO_3$) | 2203 |

What is claimed is:

1. A gas-generating preparation comprising:

(a) ammonium nitrate, (b) a derivative of guanidine, wherein said derivative of quanidine is selected from the group of triaminoguanidine azide, quanidine ditetrazole, aminoguanidine ditetrazole, triaminoguanidine nitrate, ammonium-5-nitro aminotetrazole, triaminoguanidine-5-nitroaminotetrazole, and nitroquanidine, and (c) a deflagration catalyst comprising at least one inorganic compound, wherein the preparation comprises from 50 to 75 wt % of ammonium nitrate and the deflagration catalyst comprises one of copper(II) carbonate, iron(III) carbonate, or a mixture of copper(II) carbonate and iron(III) carbonate.

2. The gas-generating preparation according to claim 1, wherein the deflagration catalyst is copper(II) carbonate.

3. The gas-generating preparation according to claim 1, wherein the preparation comprises from 25 to 50 wt % of said derivative of quanidine.

4. The gas-generating preparation according to claim 1, wherein the preparation comprises from 0.5 to 25 wt % of said deflagration catalyst.

5. The gas-generating preparation according to claim 1, wherein the preparation comprises from 0.1 to 20 wt % of a binder comprising one of polyethylene glycol, poly(vinyl nitrate), and a mixture of polyethylene glycol and poly(vinyl nitrate).

6. The gas-generating preparation according to claim 1 wherein the preparation is in the form of one of tablets, granules and pellets.

7. The gas-generating preparation of claim 1 wherein said preparation is free of toxic materials and upon decomposition, a substantially non-toxic and solid-substance free gas is formed.

8. The gas-generating preparation of claim 1, wherein the derivative of guanidine is triaminoguanidine nitrate.

* * * * *